US005197175A

United States Patent [19]

Yuen

[11] Patent Number: 5,197,175

[45] Date of Patent: Mar. 30, 1993

[54] ROTATING BEAD STRINGING APPARATUS

[76] Inventor: Po-Ling Yuen, Johan de Wittlaan 46, 1421 XD Uithoorn, Netherlands

[21] Appl. No.: 844,282

[22] Filed: Mar. 2, 1992

[51] Int. Cl.[5] ..... B25A 19/04

[52] U.S. Cl. ..... 29/241

[58] Field of Search ..... 223/48; 414/27; 221/164, 166; 198/388; 29/241, 433

[56] References Cited

U.S. PATENT DOCUMENTS

| | | | |
|---|---|---|---|
| 2,998,119 | 8/1961 | Winberg | 198/388 |
| 3,545,069 | 12/1970 | Krieger | 29/433 |
| 4,280,266 | 7/1981 | Tomita et al. | 29/241 |
| 4,785,521 | 11/1988 | Ho | 29/241 |

FOREIGN PATENT DOCUMENTS

| | | | |
|---|---|---|---|
| 2-89714 | 3/1990 | Japan | 198/388 |
| 361650 | 6/1987 | U.S.S.R. | 198/388 |

*Primary Examiner*—Robert C. Watson
*Attorney, Agent, or Firm*—Harris Zimmerman

[57] ABSTRACT

A bead stringing device to enable an individual quickly to asssemble a large quantity of beads on a wire or string comprises an assembly of a pedestal base which supports a rotatable bowl. The bowl includes a bottom panel and a circumferential side wall that is curved to form a convex cross-section. A mandrel is disposed coaxially with the side wall and extends upwardly from the bottom panel, and a knob extends upwardly from the mandrel through the open upper end of the bowl. A socket is formed in the bottom panel coaxially with the side wall and the mandrel, and is dimensioned to receive a shaft extending upwardly from the pedestal base. The knob is provided so that an individual may grasp the knob and spin the bowl about the shaft of the pedestal base. A hook-like wire is adapted to be extended into the open upper end of the bowl adjacent to the side wall thereof. A large plurality of beads are placed in the bowl, and the bowl is rotated manually using the knob, while the hook-like wire is placed into the bowl. The rotational motion causes the beads to circulate reiteratively past the hook end of the wire. The bead are oriented randomly; some of the bead holes are aligned with the hook as they pass by, and are captured by the hook. The hook may extend to a wire for storing and assembling the beads, or the hook may be secured to string, line, cord, or the like.

4 Claims, 2 Drawing Sheets

ROTATING BEAD STRINGING APPARATUS

BACKGROUND OF THE INVENTION

In virtually every society and culture throughout the world, there is a history of the use of beads to form decorative designs for jewelry, artistic creations, and other adornments. Beads have been produced by hand labor and by automated machine, formed of a variety of materials such as glass, plastic, bone, ceramic, shell, coral, wood, and other substances. Beads are provided with varying colors and surface treatments to enable artists to assemble designs of infinite variety and unique creativity. The beads are generally provided with a hole therethrough, assembled (strung) on string, wire, cord, or the like, and the strings are then joined into a coherent design. Stringing is accomplished by inserting the free end of a wire or needle through the hole in each bead, a manual process that is painstaking.

The stringing process is the most arduous and the least creative step in creating a bead design. Moreover, it is generally believed that smaller beads are more desirable to create more complete and intricate artistic works. However, smaller beads are more difficult to string, and the more beads that are used, the more time must be spent carrying out the stringing process. These factors run counter to the artist drive for greater intricacy and larger creations using more beads.

SUMMARY OF THE PRESENT INVENTION

The present invention generally comprises a bead stringing device that enables an individual quickly to assemble a large quantity of beads on a wire, string, or the like. A significant feature of the invention is that beads of virtually any size may be strung by the device. Moreover, it is no more difficult to string beads of smaller diameters than larger beads, so that the artist or jeweler does not require more time for stringing to create more intricate designs.

The bead stringing device comprises a simple assembly of a pedestal base which supports a rotatable bowl. The bowl includes a bottom panel and a circumferential side wall that is curved to form a convex cross-section. A mandrel is disposed coaxially with the side wall and extends upwardly from the bottom panel, and a knob extends upwardly from the mandrel through the open upper end of the bowl. A socket is formed in the bottom panel coaxially with the side wall and the mandrel, and is dimensioned to receive a shaft extending upwardly from the pedestal base. The knob is provided so that an individual may grasp the knob and spin the bowl about the shaft of the pedestal base.

The device also includes a hook-like wire that is adapted to be extended into the open upper end of the bowl adjacent to the side wall thereof. A large plurality of beads are placed in the bowl, and the bowl is rotated while the hook-like wire is placed into the bowl. The rotational motion causes the beads to circulate reiteratively past the hook end of the wire. The beads are oriented randomly; some of the bead holes are aligned with the hook as they pass by, and are captured by the hook. The hook may extend to a wire for storing and assembling the beads, or the hook may be secured to string, line, cord, or the like.

Only a few spins of the bowl are required to load a plurality of beads onto the hook. This process is much faster and less arduous than stringing beads by hand, as done in the prior art. The ease of stringing beads using the invention encourages the increased use and consumption of beads, which is advantageous for manufacturers and retailers of beads and related paraphernalia.

DESCRIPTION OF THE PREFERRED EMBODIMENT

Figure 1:
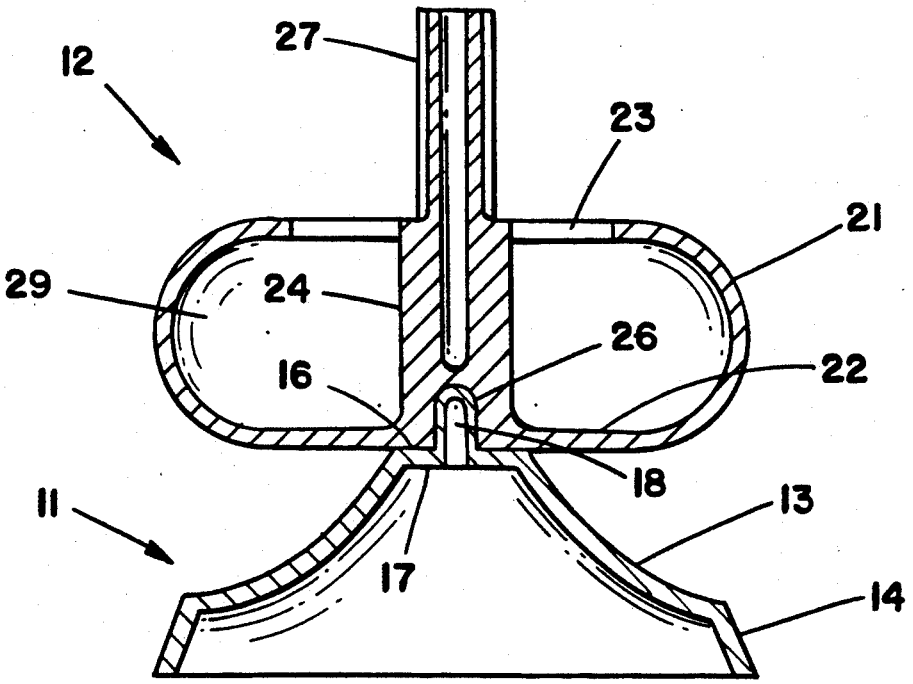
FIG. 1 is a cross-sectional elevation of the rotatable bead stringing device of the present invention.
Figure 2:
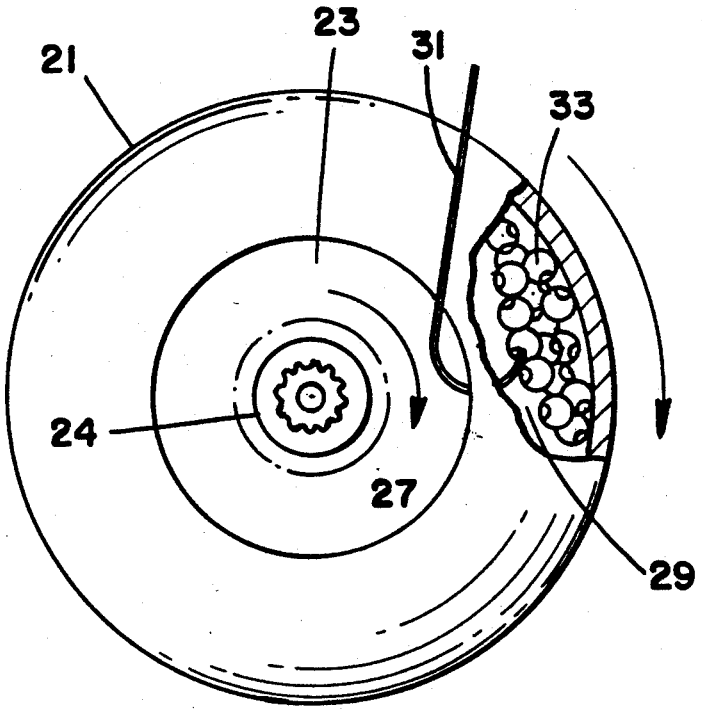
FIG. 2 is a partially cutaway top plan view of the rotatable bead stringing device shown in FIG. 1.
Figure 3:
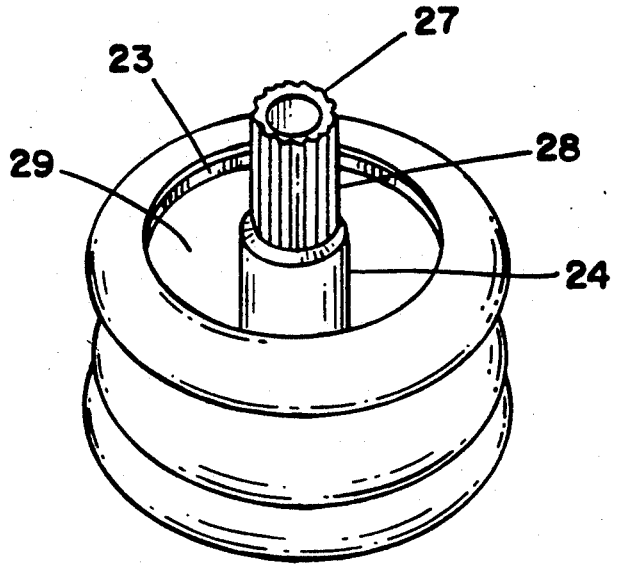
FIG. 3 is a perspective view of the rotatable bead stringing device shown in FIGS. 1 and 2.

The present invention generally comprises a bead stringing device that enables an individual quickly to assemble a large quantity of beads on a wire, string, or the like. With regard to FIGS. 1–3, the device broadly comprises a pedestal base 11 and a bowl 12 supported on the base 11 in rotatable fashion. The pedestal base 11 comprises a closed curved sidewall 13 having a truncated conical configuration, and an annular skirt 14 extends from the lower edge of the curved sidewall 13. An upper end wall 17 forms the truncation of the conical sidewall, and a shaft 18 extends upwardly from the end wall 17 coaxially with respect to the sidewall 13 and skirt 14. The skirt, side wall and end wall define a strong and rigid pedestal, and the upper surface of the end wall 17 defines an annular land 16 about the shaft 18.

The bowl 12 comprises a closed curved sidewall 21 having a convex curvature in a cylindrical ellipsoid configuration, joined to a bottom wall 22. The sidewall 21 defines an upper opening 23 approximately coaxial to the bottom wall 22. A mandrel 24 extends upwardly from the bottom wall, and is disposed coaxially with respect to the sidewall, bottom wall, and upper opening 23. A knob 27 extends axially upwardly from the mandrel 24 through the opening 23, and includes exterior ribs 28, a knurled surface, or the like to enhance the tactile grip of the knob 27. The area of the opening 23 is sufficient to permit the loading and unloading of beads in the coffer 29 defined by the sidewall 21 and bottom wall 22. The reentrant curve of the interior of the sidewall 21 retains a large plurality of beads within the coffer 29, while also forming a strong, lightweight structure.

Figure 4:
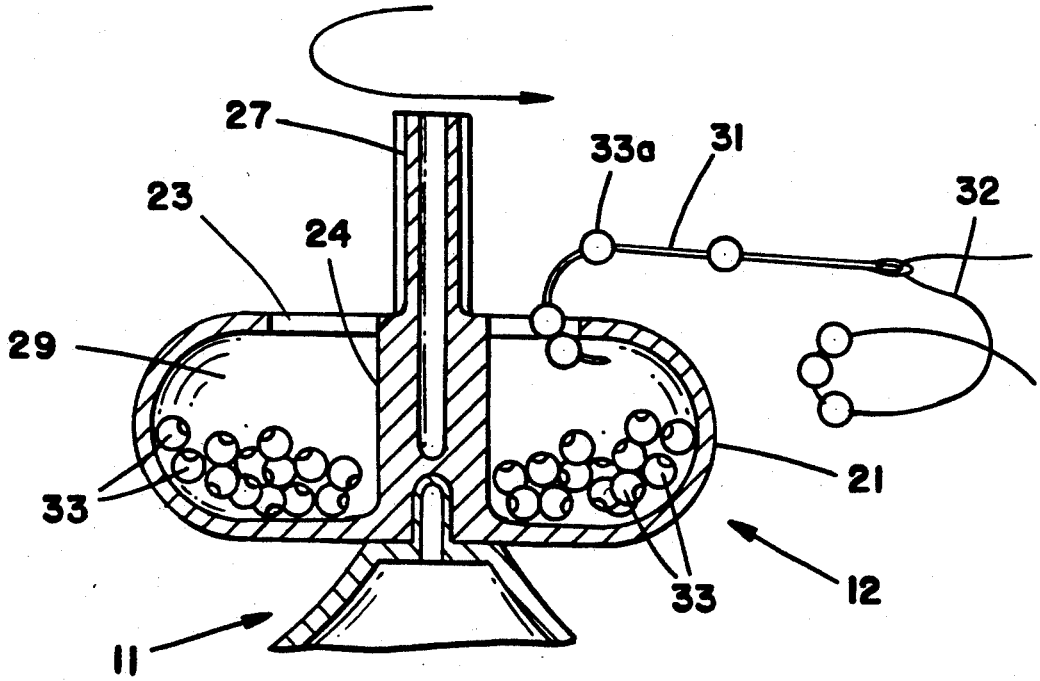
FIG. 4 is a cross-sectional view illustrating the method of using the rotatable bead stringing device to assemble strings of beads.

The apparatus also includes a hook 31 formed of wire, plastic, or any other form-retaining material. With regard to FIG. 4, the method of using the invention begins with a plurality of beads 33 introduced into the coffer 29 of the bowl 12 through the opening 23 thereof. The hook 31 is then introduced into the opening 23, and knob end of the mandrel is grasped manually and rotated like a toy top. The beads 33 are rotated together with the bowl 12, and are urged radially outwardly by centrifugal force. The beads thus form an endless annular stream of beads circulating past the hook end. The end of the hook is directed toward and into the oncoming annular stream of beads. Although the beads are oriented randomly, a few beads 33*a* of the large plurality of beads 33 are oriented to be picked up by the hook end 31. The beads are flung onto the hook at a velocity determined by the rate of rotation of the bowl. The individual using the apparatus can adjust the speed to permit the beads 33*a* to circulate onto the hook shank.

The hook may be tied to a string or thread 32, or any flexible linear member, to place a larger quantity of beads in a linear array. The process may be continued until a predetermined number of beads 33*a* are placed on the hook and string. It is significant to note that the hook stirs the passing stream of beads, causing the random order of the beads to change with each rotation and causing the process to continue successfully.

The bowl 12 may contain a random assortment of beads, so that a random design of differing beads will assemble on the hook 31 and string 32. It may be apparent to a skilled artisan that a plurality of bowls 12 may be used, each storing a plurality of beads of identical color, size, surface, indicia, or the like. The hook 31 may be dipped into a bowl containing a desired type of bead, and the bowl 12 spun sufficiently to string a predetermined number of the desired beads onto the hook and string. The same hook may then be introduced in other bowls containing other types or varieties of beads, so that the artist or jeweler can add selected beads on the string in a planned way to create a bead design consisting of an assembly of one or more bead strings. It may be appreciated that the stringing process is greatly accelerated compared to prior art techniques, so that the artisan can complete bead assemblies more quickly with less painstaking labor.

The device is designed in a simplified fashion that is optimally produced by injection molding of plastic material to form an inexpensive, yet sturdy and utilitarian apparatus. The low cost of the device permits the bead artisan to purchase a large quantity of bowls and pedestals, so that beads may be sorted and stored by type in the individual bowls, ready for stringing without further manipulation.

I claim:

1. A device for assembling beads having holes extending therethrough, comprising rotatable bowl means for containing a plurality of beads, said bowl means having a closed curved sidewall defining a bowl opening extending upwardly, means for rotating said bowl means manually to circulate the beads annularly in said bowl, said means for rotating said bowl means including a mandrel extending from said bowl coaxially with said closed curved sidewall, and hook means extendable into said opening for hooking some of the beads as the beads circulate past said hook means.

2. The device of claim 1 for assembling beads, wherein said means for rotating said bowl means further includes a knob extending coaxially from said mandrel and outwardly from said bowl opening.

3. A device for assembling beads having holes extending therethrough, comprising rotatable bowl means for containing a plurality of beads, said bowl means having an opening therein, means for rotating said bowl means manually to circulate the beads annularly in said bowl, hook means extendable into said opening for hooking some of the beads as the beads circulate past said hook means, means for supporting said bowl in rotatable fashion, said means for supporting said bowl means in rotatable fashion including a ground engaging base means, said base means including a shaft extending upwardly therefrom, and said bowl means including a socket disposed in a lower surface thereof coaxially with said closed curved sidewall, said socket being dimensioned to receive said shaft in freely rotating relationship.

4. A device for assembling beads having holes extending therethrough, comprising rotatable bowl means for containing a plurality of beads, said rotating bowl means including a closed curved sidewall defining a bowl opening extending upwardly, said closed curved sidewall generally comprising a cylindrical ellipsoid, means for rotating said bowl means manually to circulate the beads annularly in said bowl, and hook means extendable into said opening for hooking some of the beads as the beads circulate past said hook means.

* * * * *